US008062047B1

(12) United States Patent
Wang et al.

(10) Patent No.: US 8,062,047 B1
(45) Date of Patent: Nov. 22, 2011

(54) CONNECTOR

(75) Inventors: Hung-Chi Wang, Taoyuan Country (TW); Mei-Chuan Yang, Taoyuan Country (TW)

(73) Assignee: Proconn Technology Co., Ltd., Taoyuan Country (TW)

( * ) Notice: Subject to any disclaimer, the term of this patent is extended or adjusted under 35 U.S.C. 154(b) by 0 days.

(21) Appl. No.: 13/005,914

(22) Filed: Jan. 13, 2011

(51) Int. Cl.
*H01R 13/62* (2006.01)

(52) U.S. Cl. ..... 439/328; 439/83

(58) Field of Classification Search ..... 439/83, 439/326, 327, 328
See application file for complete search history.

(56) References Cited

U.S. PATENT DOCUMENTS 6,634,900 B2 * 10/2003 Hu et al. ..... 439/328
7,927,120 B1 * 4/2011 Wang et al. ..... 439/328
2011/0111614 A1 * 5/2011 Kato ..... 439/328
2011/0171847 A1 * 7/2011 Zhu ..... 439/327
* cited by examiner

*Primary Examiner* — James Harvey
(74) *Attorney, Agent, or Firm* — WPAT, P.C.; Anthony King

(57) ABSTRACT

A connector soldered to a PCB has an insulating housing of which two opposite ends are recessed to form a pair of holding recesses, terminals mounted in the insulating housing with soldering portions projected out of a bottom of the insulating housing, a supporting member and a positioning member. The supporting member has a base slice having a bottom thereof extending horizontally to form a supporting slice which has a through slot and a pair of receiving slots. The positioning member has two soldering portions soldered with the PCB and a linking portion of inverted-U shape connecting the two soldering portions. The linking portion has two arms inserted in the corresponding receiving slots. The height of the linking portion is bigger than the thickness of the supporting slice to form intervals between the supporting slice and the positioning member to achieve an up-and-down movement of the positioning member.

7 Claims, 3 Drawing Sheets

CONNECTOR

BACKGROUND OF THE INVENTION

1. Field of the Invention

The present invention relates to a connector, and more particularly to a connector capable of ensuring a steady connection between terminals thereof and a printed circuit board (PCB).

2. The Related Art

Referring to FIGS. 4-5, a conventional connector 100' has an insulating housing 10', a plurality of terminals 20' mounted in the insulating hosing 10' and each having a soldering portion 21' projecting out of a bottom of the insulating housing 10' for being soldered with a PCB, a pair of latch members 30' mounted in two opposite ends of the insulating housing 10' respectively and further projecting forward out of the insulating housing 10', and a pair of positioning members 40' mounted on fronts of the latch members 30' respectively. The positioning member 40' has a pair of soldering plates 41' and a fixing portion 42' of substantially inverted-U shape linking the two soldering plates 41'. The soldering plates 41' are soldered with the PCB so as to fix the latch member 30' with the PCB. However, it is difficult to keep the two soldering plates 41' always leveling with the soldering portions 21' due to the tolerance in production.

SUMMARY OF THE INVENTION

Accordingly, an object of the present invention is to provide a connector soldered to a PCB. The connector includes an insulating housing having two opposite ends of a front side thereof recessed rearward to form a pair of holding recesses, a plurality of terminals assembled in the insulating housing, a supporting member and a positioning member. Each of the terminals has a soldering portion projecting out of a bottom of the insulating housing for being soldered with the PCB. The supporting member has a base slice of which a rear extends rearward to form a holding slice inserted in the holding recess of the insulating housing with the base slice projecting in front of the insulating housing. A portion of a bottom of the base slice horizontally extends sideward to form a supporting slice. A front of the supporting slice is recessed rearward to form a through slot. The through slot has a lateral side recessed sideward to form a pair of receiving slots parallel with each other. The positioning member is movably mounted to the supporting slice of the supporting member. The positioning member has two soldering portions and a linking portion of substantially inverted-U shape connecting the two soldering portions. The linking portion has two arms thereof inserted in the corresponding receiving slots and a top thereof located above the supporting slice. The soldering portions are located under the supporting slice to be soldered with the PCB. The height of the linking portion is bigger than the thickness of the supporting slice to accordingly form an interval between the supporting slice and the positioning member, so that the positioning member is capable of having an up-and-down movement in order to adjust a relative position between the soldering slice and the soldering portions of the terminals.

As described above, as the higher of the linking portion is bigger than the thickness of the supporting slice, the interval is formed between the linking portion and the supporting slice and makes the positioning member be able to move up-and-down for further adjusting the soldering slices to keep leveling with the soldering portions of the terminals. So, the connector is able to keep the soldering portions of the terminals being soldered with the PCB even when there is tolerance in production.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
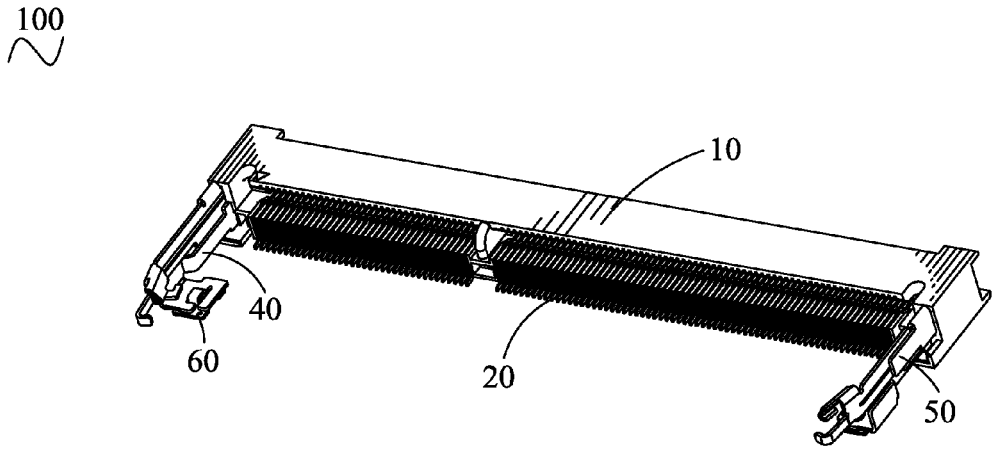
FIG. 1 is an assembled, perspective view of a connector of an embodiment in accordance with the present invention.
Figure 2:
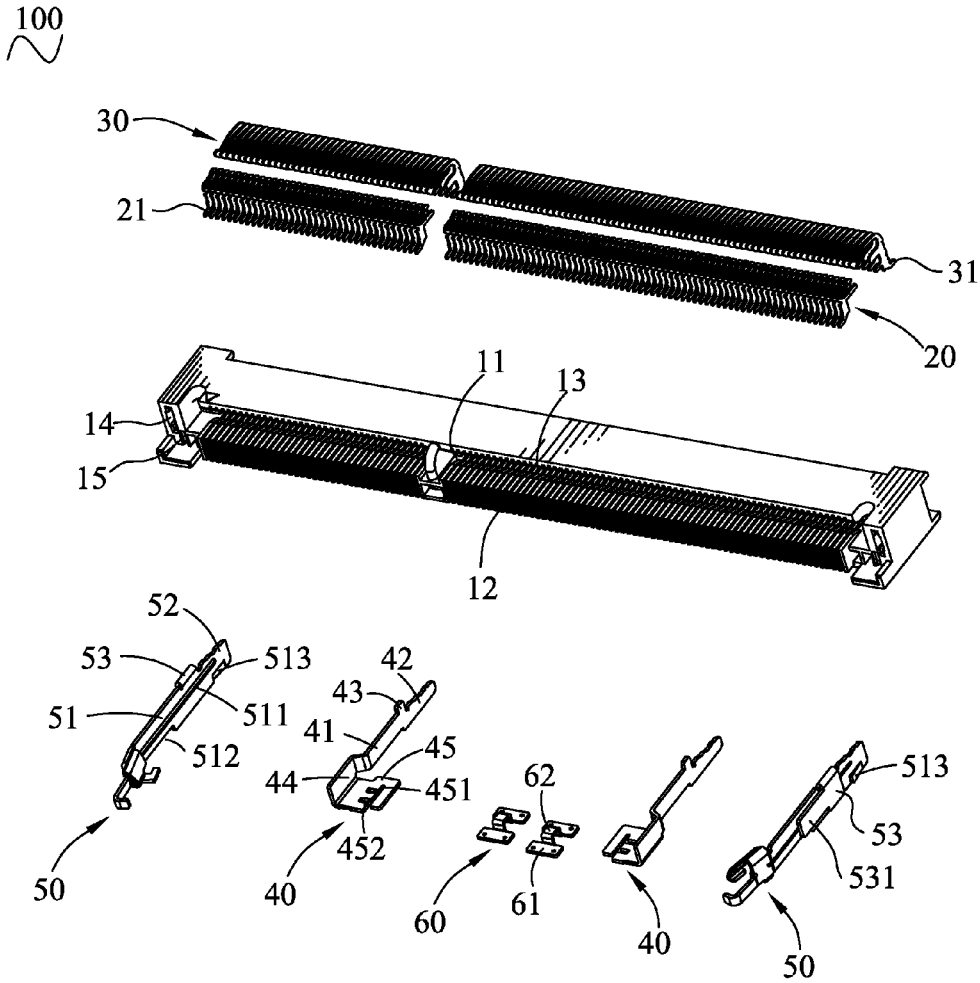
FIG. 2 is an exploded, perspective view of the connector shown in FIG. 1.

Referring to the drawings in greater detail, and first to FIGS. 1-2, the embodiment of the invention is embodied in a connector 100. The connector 100 includes an insulating housing 10, a plurality of first terminals 20 and second terminals 30 mounted in the insulating hosing 10, a pair of supporting members 40 and a pair of latch members 50 mounted to two opposite ends of the insulating housing 10, and a pair of positioning members 60 movably assembled to the corresponding supporting members 40.

Figure 3:
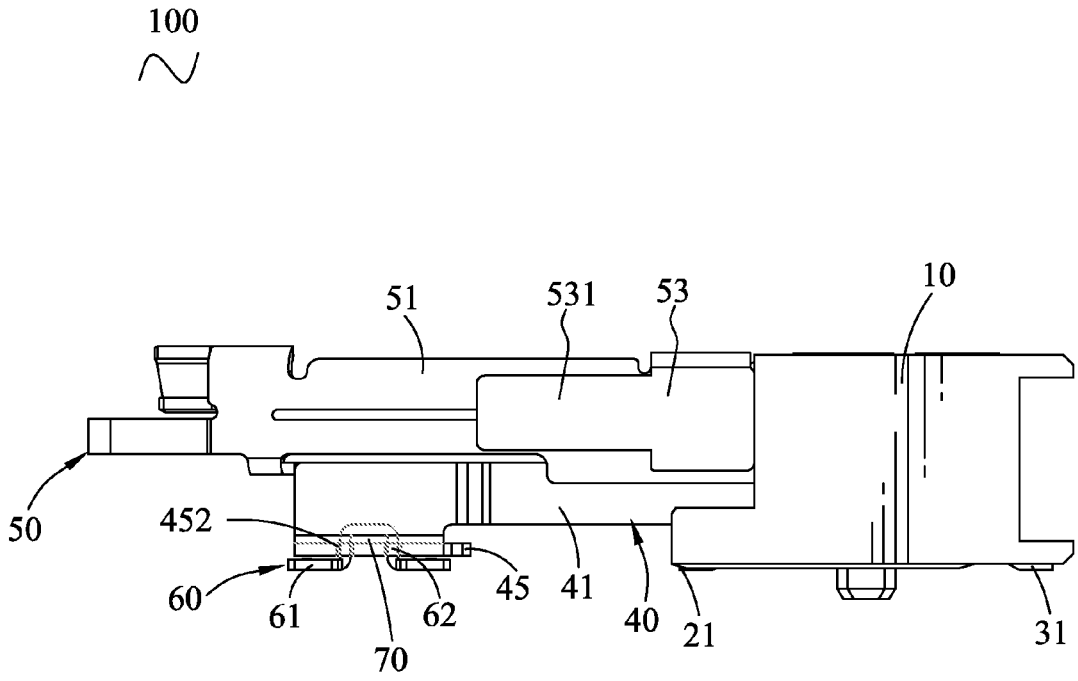
FIG. 3 is an assembled, lateral view of the connector shown in FIG. 1.
Figure 4:
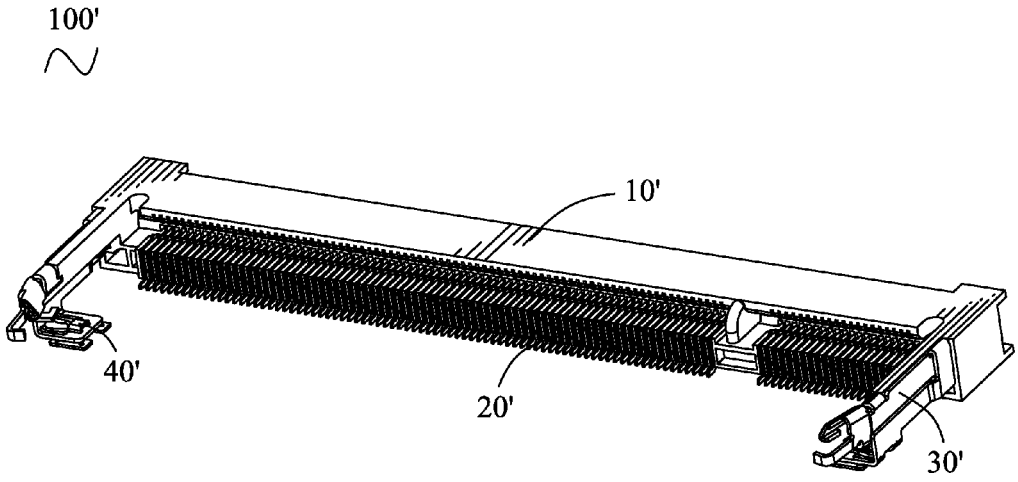
FIG. 4 (Prior Art)
FIG. 4 is an assembled, perspective view of a conventional connector.
Figure 5:
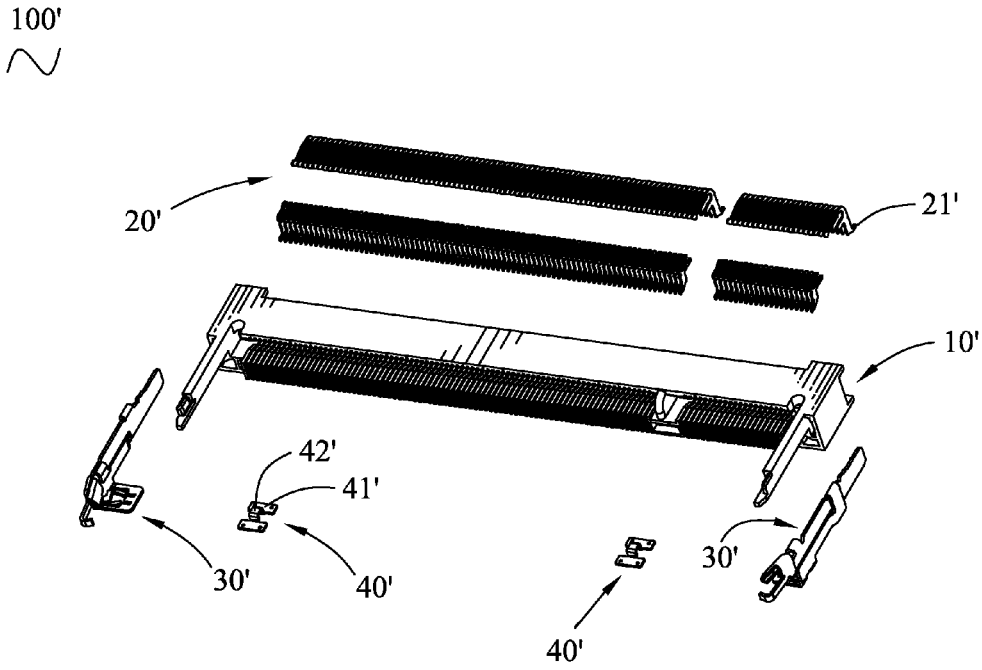
FIG. 5 (Prior Art)
FIG. 5 is an exploded, perspective view of the conventional connector shown in FIG. 4.

With reference to FIGS. 2-3, the insulating housing 10 of long rectangular shape has a front thereof recessed rearward to form a card recess 11 extending horizontally for receiving a card (not shown). A lower part of the insulating housing 10 defines a plurality of first recesses 12 arranged at regular intervals along a longwise direction thereof and communicating with the card recess 11. An upper part of the insulating housing 10 defines a plurality of second recesses 13 arranged at regular intervals along a longwise direction thereof and communicating with the card recess 11. Two opposite ends of the insulating housing 10 each has an upper portion recessed rearward to form a fixing recess 14, and a lower portion recessed rearward to form a holding recess 15. The holding recess 15 is parallel with the fixing recess 14 and adjacent to an inside of a bottom of the fixing recess 14.

The first terminals 20 are respectively assembled to the first recesses 12 and each has a first soldering portion 21 projecting out of a bottom of the insulating housing 10 for being soldered with a PCB (not shown). The second terminals 30 are respectively assembled to the second recesses 13 and each has a second soldering portion 31 projecting out of the bottom of the insulating housing 10 for being soldered with the PCB.

The supporting member 40 has a long rectangular base slice 41. A rear of the base slice 41 is extended rearward to form a holding slice 42 inserted into the holding recess 15 of the insulating housing 10, with the base slice 41 projecting in front of the insulating housing 10. The base slice 41 has a rear portion thereof extending upward to form a bump 43 resting against the front of the insulating housing 10. A front of the base slice 41 is bent outward and then extends frontward to form an extending slice 44. A bottom of the extending slice 44 extends perpendicularly and inwardly to form a rectangular supporting slice 45. A front of the supporting slice 45 is recessed rearward to form a through slot 451 passing through a top and a bottom of the supporting slice 45. The through slot 451 has a lateral side recessed towards the extending slice 44 to form a pair of receiving slots 452 spaced from and parallel with each other. The positioning member 60 has two soldering portions 61 and a linking portion 62 of substantially inverted-U shape connecting the two soldering portions 61. The inverted-U shaped linking portion 62 has two arms thereof inserted in the corresponding receiving slots 452, with a top thereof located above the supporting slice 45. The soldering portions 61 are located under the supporting slice 45 for being soldered with the PCB. As the height of the two arms of the linking portion 62 is bigger than the thickness of the supporting slice 45, an interval 70 is accordingly formed between the linking portion 62 and the supporting slice 45. The interval 70 enables the positioning member 60 moving up and down to adjust the position of the soldering portions 61.

The latch member 50 has a long rectangular base plate 51. A rear of the base plate 51 extends rearward to form a fixing plate 52 press fitted in the fixing recess 14 of the insulating housing 10 with the base plate 51 projecting in front of the insulating housing 10. A portion of a top edge of the base plate 51 adjacent to the fixing plate 52 is extended sideward and then bent downward to form a folded plate 53 apart facing the base plate 51 and resting against the front of the insulating housing 10. A front of the folded plate 53 is extended frontward to form a long rectangular elastic plate 531 apart parallel with the base plate 51 for preventing the deformation of the latch member 50 while the card is inserted into the card recess 11 of the connector 100. A middle of the base plate 51 is provided with a reinforcing rib 511 extending frontward and rearwards and crossing the whole base plate 51 for reinforcing the strength of the latch member 50. A front of the bottom of the base plate 51 has an opening 512 to take in the extending slice 44 of the corresponding supporting member 40 for preventing the supporting member 40 cocking up. A portion of the fixing plate 52 is punched sideward to form a stab 513 slanting sideward. The stab 513 rests against a lateral side of the holding recess 15 in assembly for fixing the latch member 50 firmly in the holding recess 15.

As described above, as the higher of the linking portion 62 is bigger than the thickness of the supporting slice 45, the interval 70 is formed between the linking portion 62 and the supporting slice 45 and makes the positioning member 60 be able to move up-and-down for further adjusting the soldering slices 61 to keep leveling with the soldering portions 21, 31 of the terminals 20, 30. So, the connector 100 is able to keep the soldering portions 21, 31 of the terminals 20, 30 being soldered with the PCB even when there is tolerance in production.

What is claimed is:

1. A connector soldered to a PCB, comprising:

an insulating housing having two opposite ends of a front side thereof recessed rearward to form a pair of holding recesses;

a plurality of terminals assembled in the insulating housing, each of the terminals having a soldering portion projecting out of a bottom of the insulating housing for being soldered with the PCB;

a supporting member having a base slice of which a rear extends rearward to form a holding slice inserted in the holding recess of the insulating housing with the base slice projecting in front of the insulating housing, a portion of a bottom of the base slice horizontally extending sideward to form a supporting slice, a front of the supporting slice being recessed rearward to form a through slot, the through slot having a lateral side recessed sideward to form a pair of receiving slots parallel with each other; and a positioning member movably mounted to the supporting slice of the supporting member the positioning member having two soldering portions and a linking portion of substantially inverted-U shape connecting the two soldering portions, the linking portion having two arms thereof inserted in the corresponding receiving slots and a top thereof located above the supporting slice, the soldering portions being located under the supporting slice to be soldered with the PCB, wherein the height of the linking portion is bigger than the thickness of the supporting slice to accordingly form intervals between the supporting slice and the positioning member, so that the positioning member is capable of having an up-and-down movement in order to adjust a relative position between the soldering slice and the soldering portions of the terminals.

2. The connector as claimed in claim 1, further comprising a latch member having a base plate, a rear of the base plate extending rearward to form a fixing plate which is press fitted in a fixing recess opened in one end of the front side of the insulating housing and adjacent to the holding recess.

3. The connector as claimed in claim 2, wherein a middle portion of the base plate is provided with a reinforcing rib extending frontward and rearwards and crossing the whole base plate.

4. The connector as claimed in claim 2, wherein a portion of a top edge of the base plate adjacent to the fixing plate extends sideward and then is bent downward to form a folded plate resting against the front side of the insulating housing for preventing the latch member further going into the fixing recess, a front of the folded plate extends frontward to form an elastic plate for preventing the deformation of the latch member.

5. The connector as claimed in claim 2, wherein a front of the base slice of the supporting member is bent towards the latch member and then extends frontward to form an extending slice, the supporting slice is formed by perpendicularly extending from a bottom edge of the extending slice, a front of a bottom of the base plate of the latch member defines an opening to take in the extending slice for preventing the supporting member cocking up.

6. The connector as claimed in claim 2, wherein a portion of the fixing plate is punched sideward to form a stab resting against a lateral side of the fixing recess for fixing the latch member in the fixing recess firmly.

7. The connector as claimed in claim 1, wherein the base slice has a rear portion thereof protruded upward to form a bump resting against the front side of the insulating housing for preventing the supporting member further going into the holding recess.

* * * * *